US007922423B2

(12) United States Patent
Perkins

(10) Patent No.: US 7,922,423 B2
(45) **Date of Patent: *Apr. 12, 2011**

(54) METHOD OF CONSTRUCTING A SECONDARY CONTAINMENT AREA

(75) Inventor: Larry L. Perkins, Midland, TX (US)

(73) Assignee: Falcon Technologies and Services, Inc., Houston, TX (US)

( * ) Notice: Subject to any disclaimer, the term of this patent is extended or adjusted under 35 U.S.C. 154(b) by 103 days.

This patent is subject to a terminal disclaimer.

(21) Appl. No.: 12/391,106

(22) Filed: Feb. 23, 2009

(65) Prior Publication Data

US 2009/0151791 A1 Jun. 18, 2009

(51) Int. Cl.
*B65D 90/24* (2006.01)

(52) U.S. Cl. ..... 405/129.55; 405/129.45; 405/129.75; 405/129.8

(58) Field of Classification Search ..... 405/129.45, 405/129.55, 129.57, 129.6, 129.65, 129.7, 405/129.75, 129.8
See application file for complete search history.

(56) References Cited

U.S. PATENT DOCUMENTS

| | | | | |
|---|---|---|---|---|
| 4,355,844 | A | 10/1982 | Muzzarelli | |
| 4,765,775 | A * | 8/1988 | Kroger | 405/129.8 |
| 4,802,322 | A | 2/1989 | Bendfeld | |
| 4,917,537 | A * | 4/1990 | Jacobson | 405/270 |
| 5,454,195 | A | 10/1995 | Hallsten | |
| 5,814,693 | A | 9/1998 | Priest et al. | |
| 5,882,142 | A * | 3/1999 | Siglin et al. | 405/52 |
| 6,026,760 | A | 2/2000 | Phillips et al. | |
| 6,315,495 | B1 | 11/2001 | Starheim | |
| 6,695,534 | B2 | 2/2004 | Cain et al. | |
| 6,841,111 | B2 | 1/2005 | Rickner et al. | |
| 6,854,926 | B2 | 2/2005 | Siglin et al. | |
| 7,494,298 | B2 * | 2/2009 | Perkins | 405/129.55 |
| 2002/0137871 | A1 | 9/2002 | Wheeler et al. | |
| 2005/0058838 | A1 * | 3/2005 | Markusch et al. | 428/423.1 |
| 2005/0158131 | A1 * | 7/2005 | Markusch et al. | 405/302.7 |
| 2006/0027794 | A1 | 2/2006 | Heinz | |
| 2006/0057394 | A1 * | 3/2006 | Cork | 428/423.1 |
| 2006/0122320 | A1 | 6/2006 | Cahill et al. | |
| 2007/0208156 | A1 * | 9/2007 | Posey et al. | 528/44 |
| 2007/0208157 | A1 * | 9/2007 | Posey et al. | 528/44 |
| 2008/0003060 | A1 | 1/2008 | Perkins | |
| 2008/0092730 | A1 | 4/2008 | Hall | |
| 2009/0324335 | A1 * | 12/2009 | Fossen et al. | 405/116 |
| 2009/0324336 | A1 * | 12/2009 | Fossen et al. | 405/116 |

(Continued)

FOREIGN PATENT DOCUMENTS

EP 1514885 A1 * 3/2005

(Continued)

OTHER PUBLICATIONS

Dudley J. Primeaux II, "Polyurea Solves Temporary Issue", Polyurea Development Association, 2004.

(Continued)

*Primary Examiner* — Frederick L Lagman
(74) *Attorney, Agent, or Firm* — Haynes and Boone, LLP

(57) ABSTRACT

The method of the present invention results in a secondary containment area for above ground storage tanks. The method involves leveling the site, laying a foundation bed, building a retaining barrier around the site, covering the foundation bed and retaining barrier with a liner cloth, and applying a layer of polyurea to the liner cloth and retaining barrier.

18 Claims, 4 Drawing Sheets

U.S. PATENT DOCUMENTS

| | | | | |
|---|---|---|---|---|
| 2010/0096075 | A1 | 4/2010 | Perkins et al. | |
| 2010/0098371 | A1 | 4/2010 | Perkins et al. | |
| 2010/0140262 | A1 * | 6/2010 | Whitener | 405/55 |

FOREIGN PATENT DOCUMENTS

| | | | |
|---|---|---|---|
| WO | WO 2007/136514 | | 11/2007 |
| WO | 2008003120 | * | 1/2008 |

OTHER PUBLICATIONS

"Specification for VFI-210 (210SC80) Secondary Containment Membrane on Geotextile Over Earthen Surfaces", Updated Sep. 1999.

"Geotextile Coating", Primeaux Associates LLC.

"Spraying Over Geotextile", 2001, 2003, 2005 Primeaux Associates LLC, Rev. 03.05.

"General Standard: Polyurea / Geotextile Elastomeric Lining Systems", Polyurea Development Association.

Office Action mailed Jun. 27, 2008, by the USPTO, regarding U.S. Appl. No. 11/426,996.

Notice of Allowance mailed Oct. 22, 2008, by the USPTO, regarding U.S. Appl. No. 11/426,996.

Versaflex Polyurea Sealants and Coatings:: The Polyurea People; http://www.versaflex.com.

Sherwin-Williams, http://www.sherwin-williams.com/pro/index.jsp.

Sherwin-Williams Envirolastic AR200 HD White.

The Sherwin-Williams Company Material Safety Data Sheet, B81V3300, Mar. 17, 2009.

http://polyureasystems.com/apps.htm (2005)—Markets and Applications for Spray Polyurea.

Primeaux Associates (2001)—Spraying over Geotextile.

Primeaux and Hanson (Sep. 11, 2006)—The True Polyurea Spray Elastomer Story: Chemistry, Advances, and Applications.

http://www.coastingsworld.com/contents/view/21465 (Aug. 11, 2005)—S-W polyurea helps in fight against.

* cited by examiner

METHOD OF CONSTRUCTING A SECONDARY CONTAINMENT AREA

CROSS-REFERENCE TO RELATED APPLICATION

This application claims the benefit of and priority to a U.S. patent application Ser. No. 11/426,996 filed Jun. 28, 2006, the technical disclosure of which is hereby incorporated herein by reference.

BACKGROUND OF THE INVENTION

1. Technical Field of the Invention

The present invention relates generally to above ground tanks that are used in the oil and gas industry to store fluids produced from underground hydrocarbon bearing formations, and more particularly to an improved method and an improved apparatus for containing spills or leaks from the above ground tanks so that such spills or leaks can be recovered or removed and disposed of properly before the environment is contaminated.

2. Description of the Related Art

During the production of oil or gas from an underground well, it is common for water to be produced along with the oil or gas. This water, called "produced water", is typically separated from the oil or gas at the well site and temporarily stored in above ground storage tanks (ASTs). The produced water varies in quality from one well to the next, and it can have high quantities of minerals, salts, oil, gas, sand and other substances dissolved, mixed, or suspended in it. Produced water with a high concentration of impurities can be corrosive to the walls and ancillary piping of an AST and it can be toxic to the environment. A vehicle with a large storage tank attached to it periodically travels to the well site and transfers the produced water from the AST to the storage tank on the vehicle.

FIG. 1 illustrates an AST 100 with an input stream 18 and an outlet stream 20. The flow rate of the outlet stream 20 is manipulated by way of a valve 22. The produced water travels from the underground hydrocarbon bearing formation 6, up the oil or gas well bore hole 4, into a "Christmas Tree" 10, which is an assembly of valves, pipes and fittings used to control the flow of oil and gas from a well. The water separating section 14 of the Christmas Tree 10 directs the produced water to the AST 100. Other separating sections 12 direct the oil or gas into a pipeline 16, which transports the oil or gas to other locations for further processing or sale.

FIG. 2 illustrates the AST 100 of FIG. 1 after the produced water has created a hole 26 in the wall of the AST. The hole 26 allows the produced water to spill or leak out of the AST 100 and onto the ground 2.

In the United States, state and federal law restrict the discharge of produced water into the environment. With regards to ASTs, it is typically required that a secondary containment area be in place to collect any accidental discharge of produced water from an AST in the field. The secondary containment area usually needs to have the capacity and strength to hold at least 110% of the volume of the AST, or for an array of ASTs, 110% of the largest AST in the array. A need exists for an efficient, effective, and inexpensive method of building the secondary containment area for an AST.

SUMMARY OF THE INVENTION

The present invention is thus directed to an improved method for building the secondary containment structure for an AST. The preferred embodiment of the present invention involves leveling the AST site, laying a foundation bed on the site, building a retaining wall around the site, covering the retaining wall and foundation bed with a cloth liner, and coating the retaining wall and cloth liner with a polyurea elastomer spray.

BRIEF DESCRIPTION OF THE DRAWINGS

A more complete understanding of the method of the present invention may be had by reference to the following detailed description when taken in conjunction with the accompanying drawings, wherein.

Figure 1:
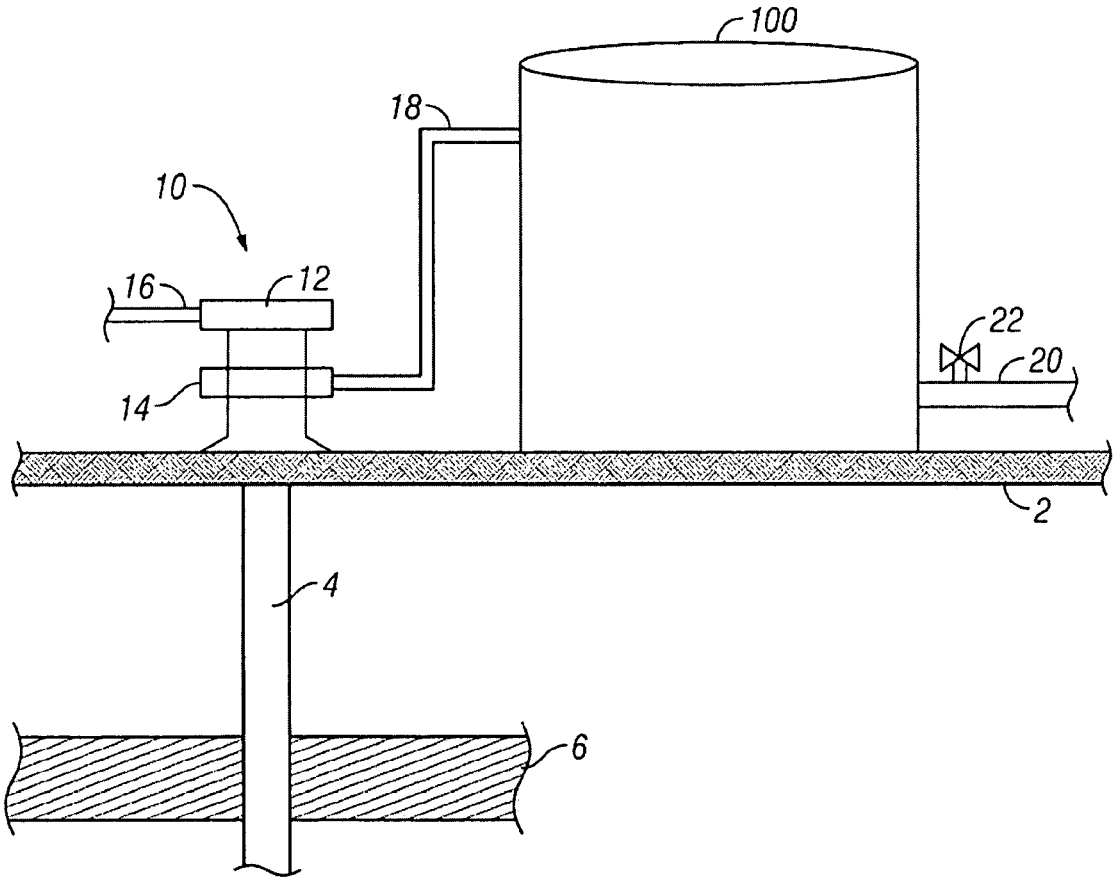
FIG. 1 (Prior Art)
FIG. 1 is an illustration of a prior art above ground storage tank at a well site.
Figure 2:
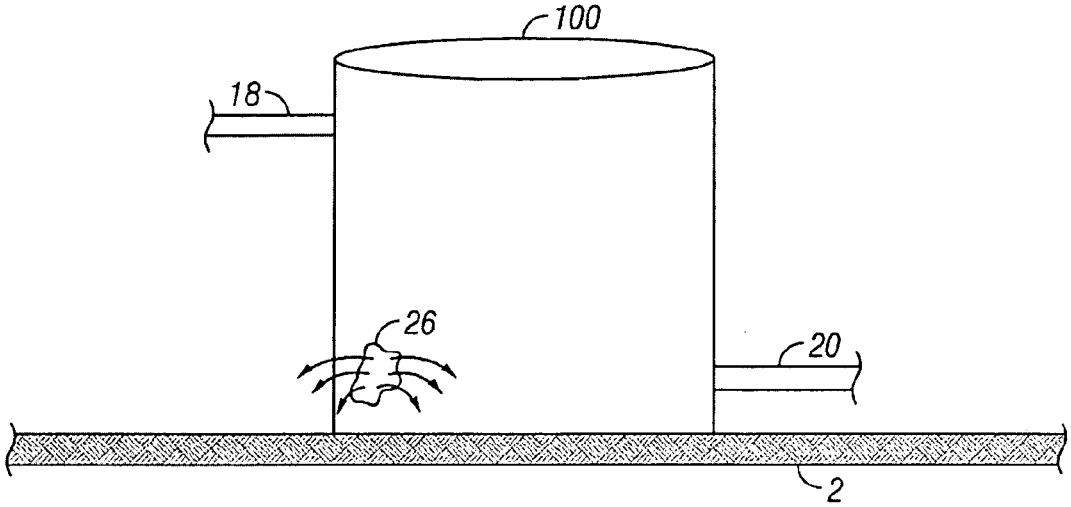
FIG. 2 (Prior Art)
FIG. 2 is an illustration of a prior art above ground storage tank with a hole in its wall.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

The present invention involves an improved method for constructing the secondary containment area for one or more above ground storage tanks (ASTs). The invention produces an effective, inexpensive, versatile secondary containment area for ASTs.

Referring initially to FIG. 1, the reference numeral 100 refers in general to an AST, which has an inlet stream 18, an outlet stream 20 and a valve 22 (or its equivalent) for manipulating the flow rate of the outlet stream (collectively referred to as the "ancillary piping"). The produced water flowing through the ancillary piping and stored in the AST 100 can be highly corrosive and, if released into the environment, can contaminate ground water in the area. The claimed invention is thus directed towards a method of constructing a secondary containment area to collect any spillage or leakage from an AST.

Even though FIG. 1 shows a cylindrical AST with its axis oriented perpendicular the ground 2, one skilled in the art knows that the claimed invention would work equally as well with ASTs of varying size, shape, and orientation relative to the ground. Accordingly, use of directional terms such as above, below, up, down, upper, and lower and the like are used with reference to the embodiments illustrated in the figures and should not be construed as limitations on the invention. In addition, although FIG. 1 depicts a single AST, the principles of the present invention are applicable to arrays of two or more ASTs.

Figure 6:
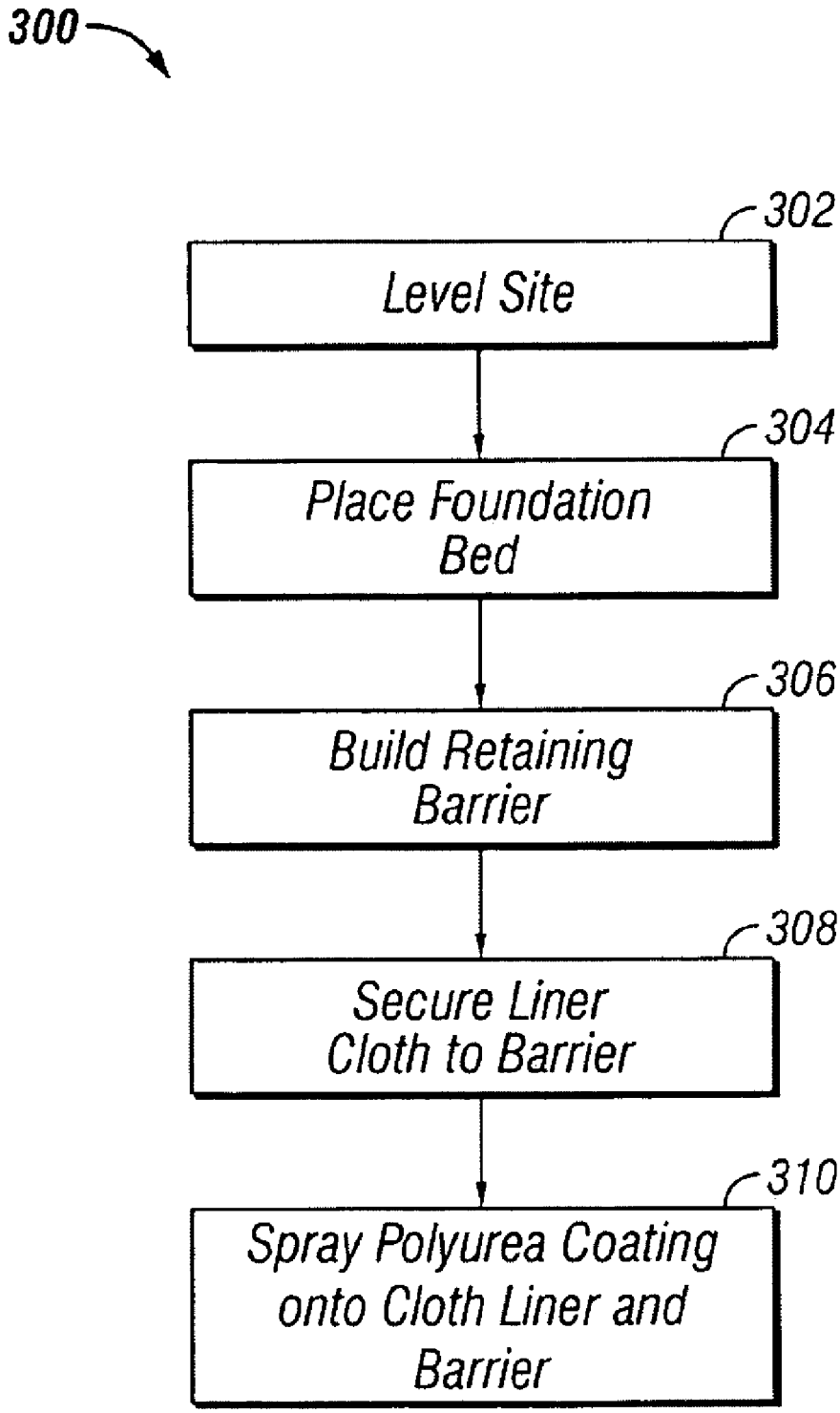
FIG. 6 is a flowchart for the claimed method.

A flowchart 300 for the claimed method is shown in FIG. 6. The secondary containment area is constructed using the following steps: leveling the AST site 302, placing a foundation bed on the site 304, building a retaining barrier around the site 306, cover the foundation bed with liner cloth and secure it to the retaining barrier 308, and coating the liner cloth and barrier with a polyurea spray 310. Each of these steps will be considered in more detail below.

Figure 3:
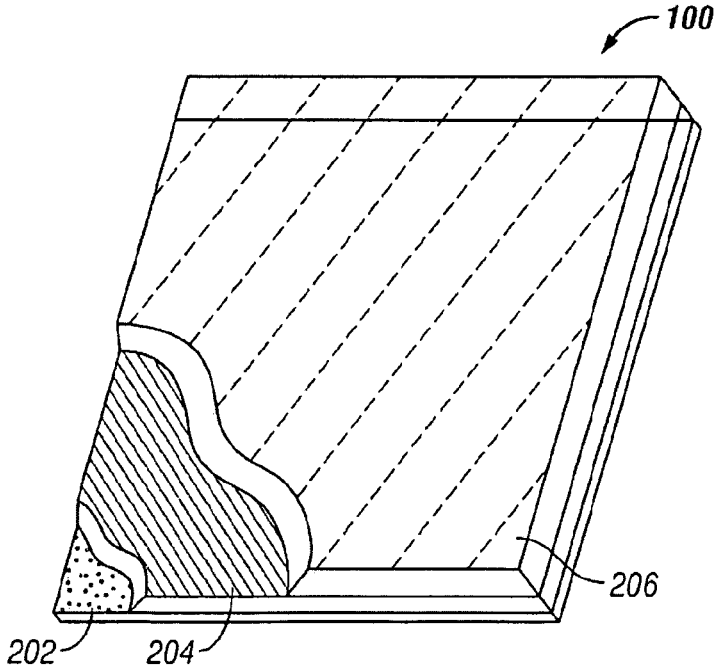
FIG. 3 is a cross-sectional view of the three layers that result from the claimed invention.

Referring now to FIG. 3, therein is depicted the three layers that result from practicing the claimed method. The foundation bed 202 supports the liner cloth 204. The foundation bed 202 is preferably composed of materials such as gravel or dirt. The foundation bed 202 is also preferably sloped towards one end or corner to allow any leakage from an AST to form a pool of liquid that can be easily pumped out of the secondary containment area. The liner cloth 204 can be a geotextile, blown fabric, felt, or an equivalent fabric with some degree of permeability so that the polyurea coating 206 can adhere to the liner cloth 204 and form a solid, impermeable layer. The liner cloth is preferably a geotextile mat with a weight between #12 ounce and #16 ounce depending on the size of the secondary containment area. The polyurea coating 206 is impervious to the liquid stored in the AST and serves to contain any spillage or leakage that may escape from the AST.

Figure 4:
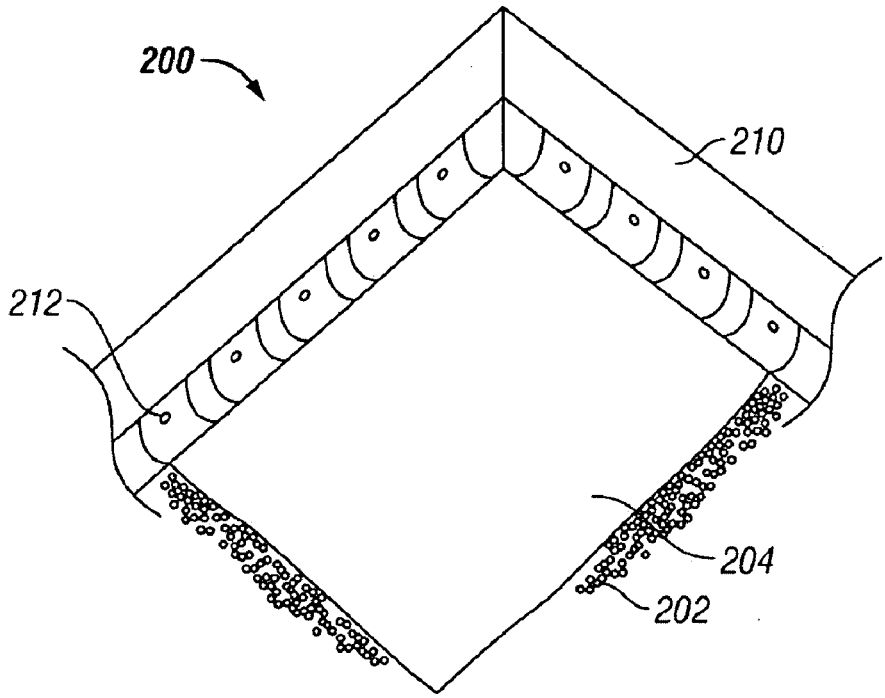
FIG. 4 is a cross-sectional view the secondary containment area after the liner cloth has been placed over the site.

Referring next to FIG. 4, therein is depicted the secondary containment area 200 after the site has been leveled, the foundation bed 202 has been laid, the retaining barrier 210 has been built, and the liner cloth 204 has been laid over the foundation bed 202 and secured to the retaining barrier 210. The AST site is leveled using means known to those skilled in the art. The retaining barrier 210 is made of any material so long as it is strong enough to withstand the pressure exerted on it when the secondary containment area 200 is completely full of produced water. The liner cloth 204 can be secured to the retaining barrier 210 by any means known to those skilled in the art, but it is preferably secured to the retaining barrier 210 by a series of bolts directly into the retaining barrier, or by a series of straps secured to the lining cloth by screws. Also, optional reinforcement panels of liner cloth can be placed in the corners of the secondary containment area, which are secured preferably using an adhesive. Although two straight retaining barriers of the secondary containment area are shown in FIG. 4, one skilled in the art would know that the retaining barriers can be straight or curved, and that the number and arrangement of retaining barriers can vary, as long as they ultimately form an area capable of containing any produced water that escapes from the AST.

Figure 5:
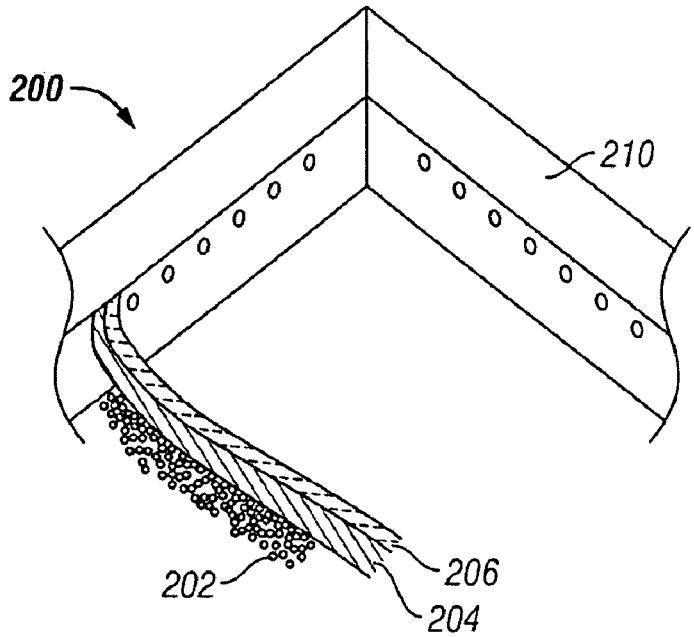
FIG. 5 is a cross-sectional view of the secondary containment area after the polyurea coating has been applied to the liner cloth and barrier wall.

Referring next to FIG. 5, therein is depicted the secondary containment area 200 after the polyurea coating 206 has been applied to the liner cloth 204. The polyurea coating is preferably applied using a spray device that operates at a temperature of approximately 165 degrees Fahrenheit and a pressure of approximately 1800 pounds per square inch. A very light base coat is first applied to the entire secondary containment area. Next, at least two more coats are applied so that the inner and outer walls of the retaining barrier have a preferable thickness of about 60 mils, with the thickness of the polyurea coating increasing to 120 mils in the area underneath the ASTs. The secondary containment area will function with a polyurea coating thickness of at least 30 mils throughout.

I claim:

1. A method for constructing a secondary containment area for above ground storage units of varying size, shape and orientation relative to the ground, comprising the steps of:

(a) providing a site for a storage unit;

(b) building a retaining barrier around said site;

(c) covering said site and a portion of the retaining barrier with a geotextile; and (d) coating said geotextile with at least one coat of polyurea to form a polyurea coating thickness of at least 30 mils to about 59 mils, wherein said method result is in the formation of a solid, impermeable layer throughout the geotextile and polyurea coating.

2. The method for constructing a secondary containment area of claim 1, wherein said method further comprises the step of leveling said site prior to step (b).

3. The method for constructing a secondary containment area of claim 1, wherein said method further comprises the step of laying a founding bed on said site prior to step (c).

4. The method for constructing a secondary containment area of claim 3, wherein said foundation bed comprises dirt.

5. The method for constructing a secondary containment area of claim 3, wherein said foundation bed comprises gravel.

6. The method for constructing a secondary containment area of claim 1, wherein said method further comprises the step of securing said geotextile to said retaining barrier prior to step (d).

7. The method for constructing a secondary containment area of claim 3, wherein said foundation bed is sloped towards one corner.

8. A method for applying a polyurea coating for the construction of a secondary containment area, said method comprising the steps of:

(a) building a retaining barrier having inner and outer walls around a containment area;

(b) covering said containment area and a portion of the retaining barrier with a geotextile;

(c) applying a light base layer of polyurea to the geotextile;

(d) applying at least two more layers of polyurea to the geotextile and retaining barrier to form a polyurea layer comprising a thickness of at least 30 mils to about 59 mils, wherein said method result is in the formation of a solid, impermeable layer throughout the geotextile and polyurea layers.

9. The method of claim 8, wherein step (d) is applied with a spray device at a temperature of about 165 degrees Fahrenheit.

10. The method of claim 8, wherein said method further comprises the step of leveling said containment area prior to step (b).

11. The method of claim 8, wherein said method further comprises the step of laying a foundation bed on said containment area prior to step (b).

12. The method of claim 11, wherein said foundation bed comprises dirt.

13. The method of claim 11, wherein said foundation bed comprises gravel.

14. The method of claim 8, wherein said method further comprises the step of securing said geotextile to said retaining barrier prior to step (c).

15. The method of claim 11, wherein said foundation bed is sloped towards one corner.

16. The method of claim 8, wherein said method further comprises the step of placing at least one reinforcement panel of said geotextile in the corners of the inner walls of said retaining barrier.

17. The method of claim 16, wherein said at least one reinforcement panel is secured in place using an adhesive.

18. The method of claim 8, wherein the inner and outer walls of the retaining barrier are curved.

* * * * *

UNITED STATES PATENT AND TRADEMARK OFFICE

CERTIFICATE OF CORRECTION

PATENT NO. : 7,922,423 B2
APPLICATION NO. : 12/391106
DATED : April 12, 2011
INVENTOR(S) : Larry L. Perkins It is certified that error appears in the above-identified patent and that said Letters Patent is hereby corrected as shown below:

Title Pg

Add the following priority claim to the front page of the Patent:

-- (63) Related U.S. Application Data
Continuation of Application No. 11/426,996, filed on
Jun. 28, 2006, now Pat. No. 7,494,298. --.

Signed and Sealed this
Seventh Day of June, 2011

David J. Kappos

David J. Kappos
*Director of the United States Patent and Trademark Office*